United States Patent [19]

Minkow

[11] 3,964,288

[45] June 22, 1976

[54] APPARATUS FOR ASSEMBLING A FRAME

[76] Inventor: Julius M. Minkow, 69 Washington St., Brooklyn, N.Y. 11205

[22] Filed: May 22, 1975

[21] Appl. No.: 579,837

[52] U.S. Cl. ..... 72/306; 72/384; 72/388

[51] Int. Cl.[2] ..... B21D 53/74

[58] Field of Search ..... 72/306, 381, 384, 387, 72/388

[56] References Cited

UNITED STATES PATENTS 2,557,346 6/1951 Green ..... 72/306

FOREIGN PATENTS OR APPLICATIONS 60,774 4/1939 Norway ..... 72/388

*Primary Examiner*—Lowell A. Larson

*Attorney, Agent, or Firm*—Friedman & Goodman

[57] ABSTRACT

Apparatus for assembling a frame fabricated from magnetically attractable material forming a strip member, the apparatus comprising a base member, a first pair of arms pivotally mounted on the base member, and a second pair of arms pivotally mounted for movement along the base member. The first pair of arms include magnets for holding the center portions of the strip for movement therewith to form a first corner of the frame. After the first corner is formed, the second pair of arms pivot to move the outer portions of the strip toward each other to enclose the frame structure. Preferably, one of the second pair of arms moves before the other arm so that one end of the strip is engaged in the opposite end of the strip to secure the final corner. Additionally, one of the second pair of arms is provided with a magnet to position a magnetically attractable catch member relative to the frame for movement therewith. Preferably, each of the pivot points is in alignment with an associated corner of the frame so that each of the arms moves an associated side of the frame without any movement therebetween.

19 Claims, 11 Drawing Figures

APPARATUS FOR ASSEMBLING A FRAME

BACKGROUND OF THE INVENTION

The present invention relates to an assembling apparatus, and more particularly to an apparatus for assembling a frame fabricated from magnetically attractable material which is initially in the form of a strip member.

There are many instances where it is necessary to form a frame from a strip member, such frames being used for boxes, pictures, molding and the like. This operation can be done by hand, and because of the particular nature of the frame, this operation usually is done by hand. However, such hand operation is both tedious and costly. Operations of this type, when carried out by hand, also cause excessive and early fatigue for the operator, and therefore increases the likelihood of industrial accidents and higher labor costs. It will be evident, that if means were provided for replacing the hand operation by an automatic device, assembly costs can be drastically reduced, and efficiency can be greatly increased.

SUMMARY OF THE INVENTION

The present invention, as will be described more fully hereinafter, provides automatic assembly apparatus for forming a frame from a strip material. The only manual operations involved with the present invention are the positioning of the strip material onto the apparatus, and the removal of the assembled frame therefrom, however this feeding and removal of the finish frame can be accomplished by automatic operations if desired.

Briefly, the present invention provides a base member, a first pair of arms pivotally mounted on the base member, and a second pair of arms pivotally secured to block members that are free to move relative to the base member. Each of the first pair of arms include magnetic means for holding the center portion of the strip for movement therewith. The block members are also provided with engagement means for pivoting the first pair of arms. Actuating means move the block members so that the engagement means pivot the first set of arms to form a first corner of the frame. After the first corner is formed, stop means stop the first set of arms in addition to stopping the block members, while the actuating means continue to move.

As the actuating means continue to move, turning means associated therewith turn the second pair of arms inwardly to enclose the frame structure. Preferably, one of the second pair of arms turns before the other arm so that one end portion of the strip is inserted into the other end portion of the strip for securement of the final corner. Additionally, one of the second pair of arms is provided with magnetic means to position a magnetically attractable member relative to the frame for movement therewith. Spring means are used to permit one member to be moved relative to another member when the other member is held stationary. Alignment means are provided to align the second pair of arms in their pivoted position to provide the final frame corner. Preferably, each of the pivot points is in alignment with an associated corner of the frame so that each of the arms moves an associated side of the frame without any movement therebetween.

Accordingly, it is an object of the present invention to provide an apparatus for assembling a frame from a strip material which overcomes the disadvantages of the prior art.

Another object of the present invention is to provide an apparatus as described above that is automatic in operation.

A further object of the present invention is to provide an apparatus as described above including magnetic means for holding the strip material in position for movement therewith.

A still further object of the present invention is to provide an apparatus as described above having two sets of pivoting arms for forming the frame structure.

Yet another object of the present invention is to provide an apparatus as described above that is low in cost, that requires a minimum of skill in its operation, and that is inherently safe to operate.

An added object of this invention is to provide an apparatus as described above that includes pivot points in alignment with the corners of the frame so that each of the arms moves an associated side of the frame without any movement therebetween, and that includes alignment means to compensate for any dimensional variations in the strip material when forming the final corner of the frame.

And yet another added object of the present invention is to provide an apparatus as described above that includes spring means to allow a first member to move together with a second member in addition to allowing the first member to move relative to the second member when the second member is stopped.

BRIEF DESCRIPTION OF THE DRAWINGS

With the above and additional objects and advantages in view, as will hereinafter appear, this invention comprises the devices, combinations and arrangtments of parts hereinafter described by way of example and illustrated in the accompanying drawings of a preferred embodiment in which.

DESCRIPTION OF THE PREFERRED EMBODIMENT

Figure 1:
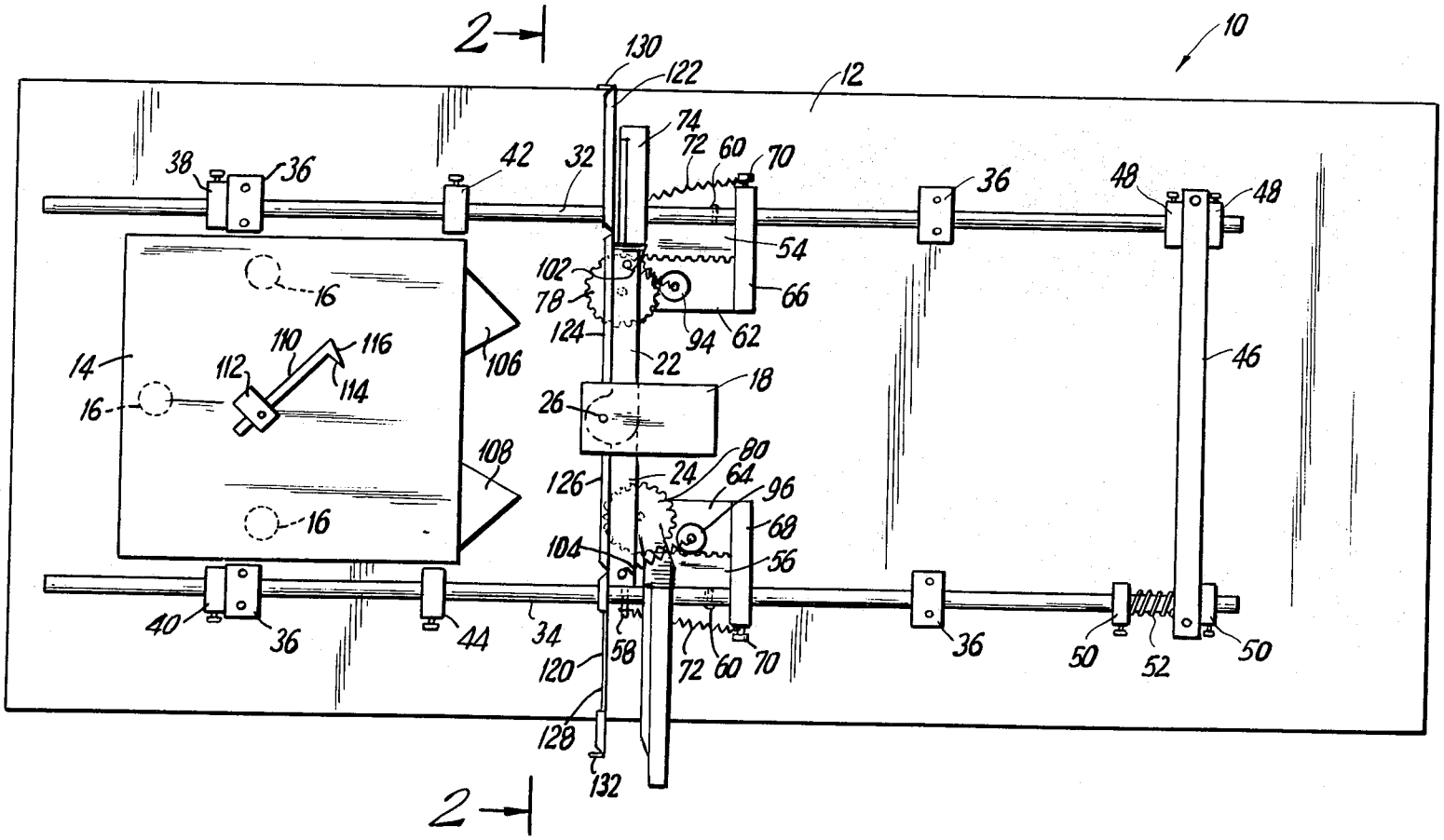
FIG. 1 represents a top plan view of an apparatus for assembling a frame pursuant to the present invention.

Referring to the drawings, FIG. 1 shows a top plan view of an apparatus 10 of the present invention for assembling a frame. The apparatus 10 includes a base member 12 having a raised platform 14 mounted thereon, being raised above the base member 12 by conventional posts 16 which are secured in a conventional manner between the platform 14 and the base member 12. The purpose of the platform 14 being spaced from the base member 12 will be discussed hereinafter below.

Figures 2, 3:
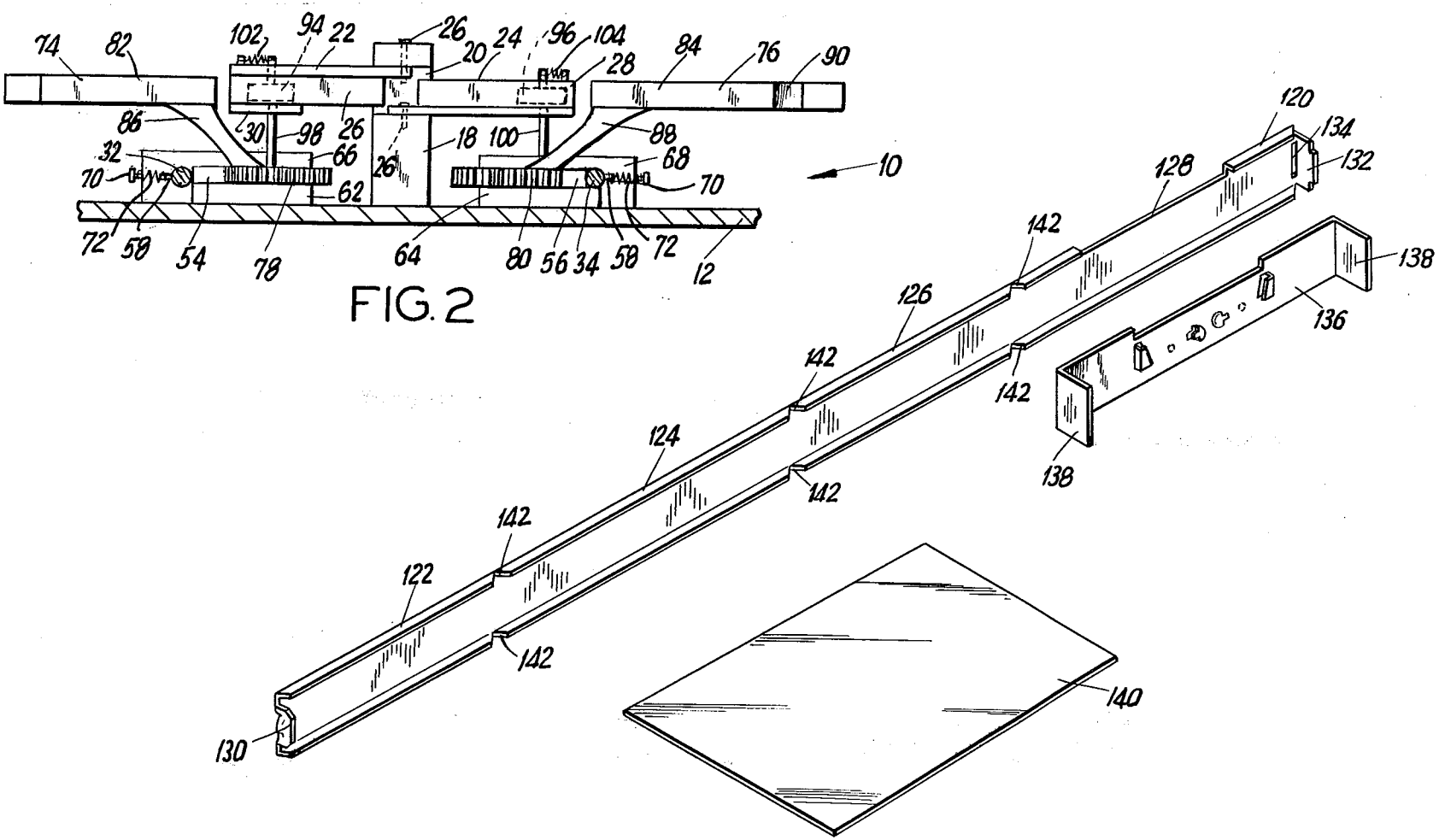
FIG. 2 represents an enlarged sectional view taken along line 2—2 of FIG. 1.
FIG. 3 represents an enlarged perspective view of the elements being assembled, including a strip member for forming the frame.
Figure 9:
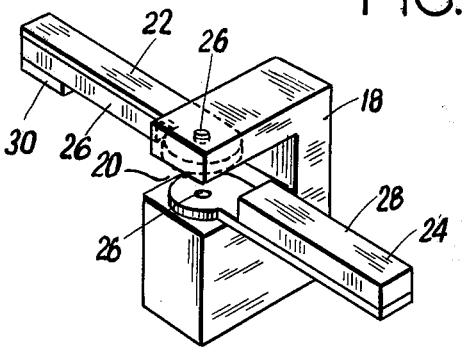
FIG. 9 represents a perspective view of the center arms of the apparatus.

A mounting block member 18 is secured to the base member 12 by conventional means, being spaced from the platform 14 and being substantially centrally disposed with respect to the platform 14. The mounting member 18, as best shown in FIGS. 2 and 9, is provided with a slot 20 facing the platform 14. A pair of arms 22, 24 are pivotally mounted by conventional pins or rivets 26 in the slot 20. The arm 22 is pivoted to an upper portion while the arm 24 is pivoted to a lower portion to provide a space between the arms. Arm 22 includes a magnet 26 extending downwardly, and the arm 24 includes a magnet 28 extending upwardly. Additionally, a stop member 30 is provided on a lower portion of the magnet 26, the function of which will be described hereinafter below.

Longitudinally extending bars or rods 32, 34 are disposed on each side of the platform 14 and mounting member 18. The rods 32, 34 pass through bearing members 36 which are secured to the base member 12 in a conventional manner, where the rods 32, 34 are free to move therethrough relative to the base member 12 and the platform 14. Conventional stop members 38, 40, 42 and 44 are secured to the bars 32, 34 for movement therewith. The stop members 38, 40 limit the return movement of the rods 32, 34 in the direction to the right as shown in FIG. 1, by abutting against the left side of the bearing members 36. The stop members 42, 44 limit the forward motion of the rod 32, 34 in the direction to the left as shown in FIG. 1, by abutting against the right side of the stationary bearing members 36. It is noted, that each of the stop members can be moved or adjusted along the length of the rods 32, 34 so that the proper stopping points for the forward and return motions can be obtained through experimentation.

An actuating bar member 46 is secured to the right ends of the rods 32, 34 as shown in FIG. 1. A pair of stop members 48, similar to those mentioned above, fix one end of the bar member 46 to the rod 32. A second pair of stop members 50, similar to those mentioned above, secure the opposite end of the bar member 46 to the rod 34. However, the stop members 50 are spaced apart with a coil spring 52 mounted on the rod 34 being disposed between the stop members 50 against the bar member 46, so that this end of the bar member 46 can move slightly along the rod 34 against the tension of the spring 52, the purpose of which will be discussed hereinafter below.

A pair of rack members 54, 56 are secured to the rods 32, 34 with their teeth facing inwardly towards each other, being secured by conventional pins, screws or rivets 58, 60 for movement with the rods 32, 34. As is noted, the pin 58 is provided with a head thereon which extends out further than the pin 60, the function of which will be described hereinafter below in more detail.

The rack members 54, 56 rest on associated L-shaped block members 62, 64. The bottom surface of the block members 62, 64 rest on the base member 12 for sliding movement thereon. The leg portions 66, 68 of the block members 62, 64 respectively, extend upwardly from the base member 12 and outwardly beyond the rod members 32, 34 which extend through openings provided in the leg portions 66, 68 for sliding movement therebetween. A pin 70 having an enlarged head thereon extends outwardly from each leg portion 66, 68, where it is noted that the pins 70 do not engage the rods 32, 34. A coil spring 72 is connected between the associated pins 58 and 70 of each block member 62, 64, having its ends secured to the heads of the pins 58, 70. The springs 72 function to move the block members 62, 64 with the bars 32, 34 when the rack members 54, 56 are moved. However, the springs 72 by expansion thereof allow the rack members 54, 56 to move relative to the block members 62, 64 when the block members 62, 64 are stopped as will be described hereinafter below.

Figure 10:
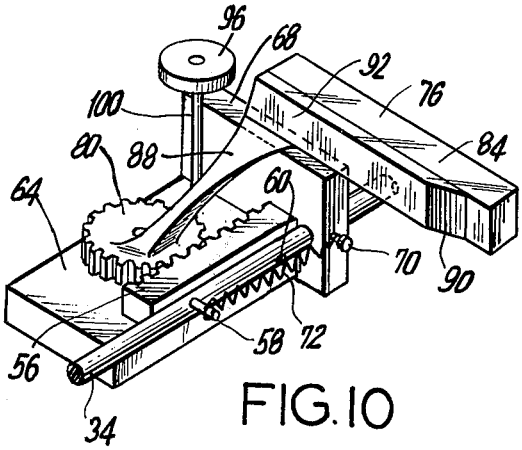
FIG. 10 represents a perspective view of an outer arm of the apparatus.
Figure 11:
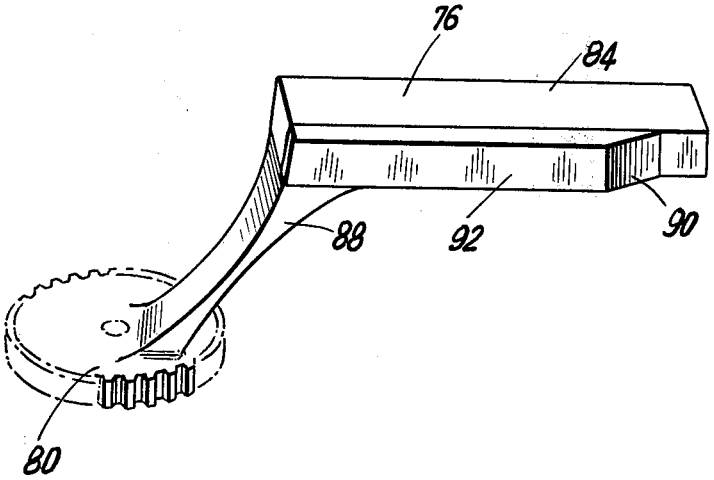
FIG. 11 represents an enlarged perspective view of the outer arm shown in FIG. 10.

As best shown in FIGS. 2 and 10, a second pair of arms 74, 76 are pivotally mounted on the block members 62, 64 respectively. FIG. 11 shows an enlarged view of the arm 76. Each of the arms 74, 76 includes a pinion member 78, 80, arm portion 82, 84 and an intermediate portion 86, 88 which extends upwardly and away from the pinion member 78, 80 to position the arm portion 82, 84 away from the pivot point of the arm 74, 76 to provide clearance therefor.

The pinion members 78, 80 are rotatably secured to the block members 62, 64 in a conventional manner so that the teeth of the pinions 78, 80 mesh with the teeth of the rack members 54, 56, respectively. Preferably, as will be pointed out hereinafter below, it is desired that the arm 76 completes its rotation before the arm 74. This may be accomplished in many ways, such as decreasing the circumferencce of the pinion member 80 with respect to the circumference of the pinion member 78 so that the pinion member 80 would rotate at a faster rate relative to the rack members. Additionally, the position of the arm 76 can be advanced in front of the arm 74 by repositioning the teeth of the pinion member 80 with respect to the rack member 56 so that the teeth of the pinion member 80 are in advance or in front of the corresponding teeth of the pinion member 78 with respect to their associated rack members 54, 56, where this advancement need only be two or three teeth thereof to satisfy the requirement of the present invention.

Additionally, the front end portion of the arm portion 84 is provided with an inclined surface 90, to aid in the alignment of the arm portions 82, 84 when pivoted together. Furthermore, the member having the inclined surface 90 is preferably a magnet 92, the function of which will be discussed hereinafter below.

A wheel 94, 96 is rotatably mounted on a post 98, 100 which is secured to the block member 62, 64 respectively. A spring 102, 104, shown in FIGS. 1, 4, 5 and 6, connects the wheel to a respective arm 22, 24. The wheels 94, 96 abut against the arms 22, 24, respectively, and rotate or pivot the arms when the block members 62, 64 are moved in the forward direction, to the left as shown in FIG. 1, by actuation of the bar member 46. In the reverse direction, the springs 102, 104 under tension return the arms 22, 24 to their original position as shown in FIG. 1. Preferably, the wheels 94, 96 roll along the surfaces of the arms 22, 24 to reduce friction therebetween.

As shown in FIG. 1, a pair of stop members 106, 108 are disposed on the undersurface of the platform 14 and extend outwardly therefrom for abutment with the lower surface of the arm 24 and the stop member 30 on the arm 22. The stop members 106, 108 have approximately the same thickness as the stop member 30 to permit the block members 62, 64 to pass thereunder. The coacting surfaces of the stop members 106, 108 provide a right angle when abutted by the arms 22, 24.

However, it is understood, that this angle may be changed as desired by adjusting the coacting surfaces of the stop members 106, 108 to any desired angle.

Figure 6:
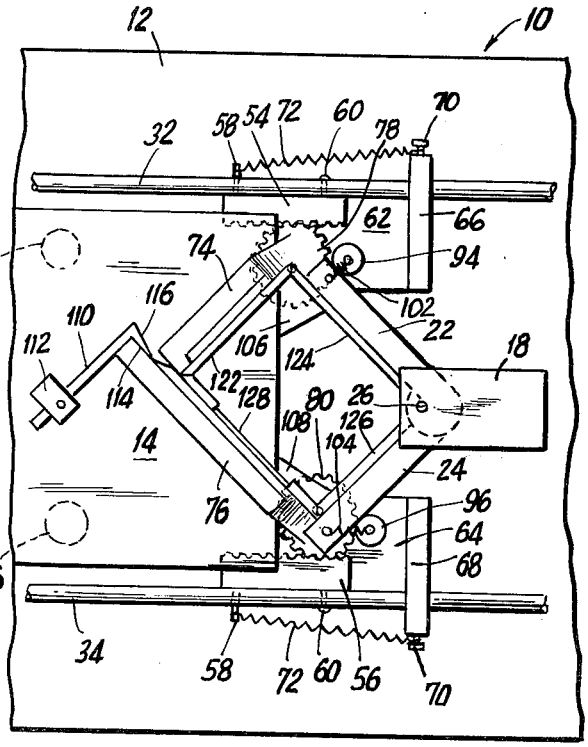

A stop member 110 is mounted on the top surface of the platform by a block member 112 which is secured to the platform 14. The stop member 110 extends through an opening in the block member 112 and is secured thereto in a conventional manner such as by screw means, where the stop member 110 can be adjusted by sliding it in or out of the block member 112 and tighten the screw means when the stop member 110 is in its desired position. The stop member 110 has a stopping surface 114 for abutting against the end portion of the arm portion 84 of the arm 76. The surface 116 opposite the stopping surface 114 is inclined to provide alignment for the arm 74 when it is pivoted to the final closed position as best shown in FIG. 6. Additionally, the inclined surface 116 of the stop member 110 and the inclined surface 90 of the arm 76 accommodate and compensate for any dimensional variations in the structure of the frame to be assembled.

Figure 7:
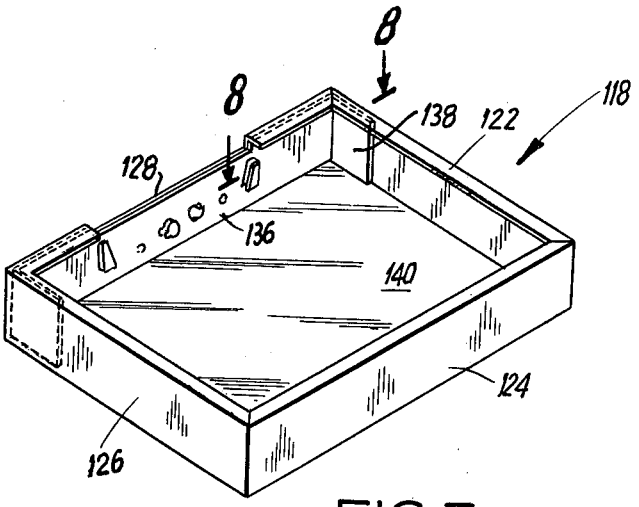
FIG. 7 represents a perspective view of a box member formed by the apparatus from the elements shown in FIG. 3.

FIG. 3 discloses the components of a box 118, shown in FIG. 7, which is to be formed by the apparatus of the present invention. The components include a strip member 120 having channeled sides 122, 124, 126 and 128. A tab 130 is provided perpendicularly on the free end of the side 122, and a tab 132 having a slot 134 therein to receive the tab 130, is provided perpendicularly on the opposite free end of the side 128. A catch member 136 is provided with perpendicularly extending portions 138. A bottom member 140 completes the box 118. The strip member 120 and the catch 136 are fabricated from a magnetically attractable material, the function of which will be described immediately below. Additionally, the flangts of the strip member 120 are notched at 142 to facilitate easy bending thereof at the desired locations.

The operation of the apparatus of the present invention will now be described, referring particularly to FIGS. 1, 4, 5 and 6. The strip 120 is positioned on the arms 22, 24 as shown in FIG. 1 with side 124 being held against arm 22 and side 126 being held against arm 24 by the magnetic attraction between the magnet 26, 28 respectively and the magnetic attractable material of the strip 120. Preferably, the notches 142 between the sides 124 and 126 are positioned in alignment with the pivot pins 26 in the space between the magnets 26, 28 provided therefor. This positioning provides the sides 124, 126 with the same pivot point as the arms 22, 24 so that there is no movement between the magnets 26, 28 and the sides 124, 126 during rotation thereof.

Figure 4:
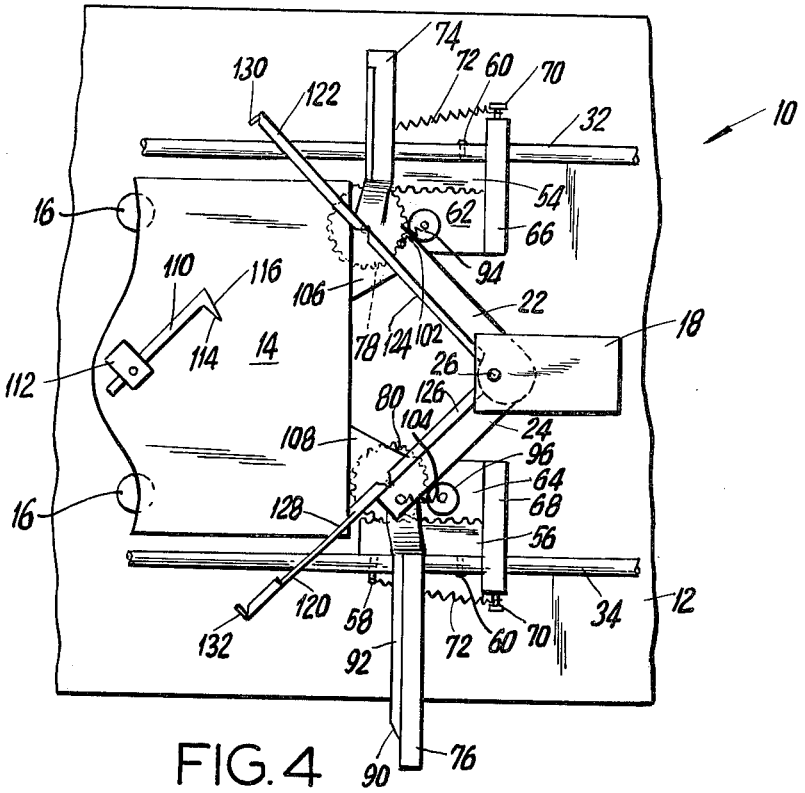
FIGS. 4, 5 and 6 represent fragmented top plan views of various positions of the apparatus during the assembling of the frame.

The actuating bar member 46 is now moved in the forward position, towards the left as shown in FIG. 1, by any conventional means well known in the art, either by hand, mechanical linkage, air pistons, electrical motors, and like means, where a further discussion thereof is not thought necessary for an understanding of the present invention. The bar member 46 moves the rods 32, 34 to the left which in turn carries therewith the rack members 54, 56 and the block members 62, 64 by means of the springs 72 so that there is no relative movement between the rack members 54, 56 and their associated block members 62, 64. The movement of the block members 62, 64 causes the wheels 94, 96 to abut against the arms 22, 24 respectively; thus causing the arms 22, 24 to pivot about the pins 26 thereby moving the sides 124, 126 of the strip 120 into a V-shape as shown in FIG. 4. When the arms 22, 24 reach the position shown in FIG. 4, they are stopped by the stop members 106, 108 which abut against the stop member 30 of arm 22 and the lower portion of arm 24, respectively. However, due to the wheels 94, 96 abutting against the now stationary arms 22, 24 respectively, the block members 62, 64 are also stopped.

However, the rods 32, 34 and the rack members 54, 56 connected thereto do not stop at this position, but continue to be moved by the bar member 46, with the rack members 54, 56 passing under the platform 14. This creates relative motion between the rack members 54, 56 and the pinion portions 78, 80 which are rotatably mounted on the now stationary block members 62, 64. Accordingly, the teeth of the rack members 54, 56 cause the pinion portions 78, 80 to rotate which in turn rotates the arms 74, 76 until they abut against the sides 122, 128 of the strip 120 respectively. It is noted that the raised platform 14 is spaced above the pinion portions 78, 80 so that the pinion portions 78, 80 are free to rotate.

Figure 5:
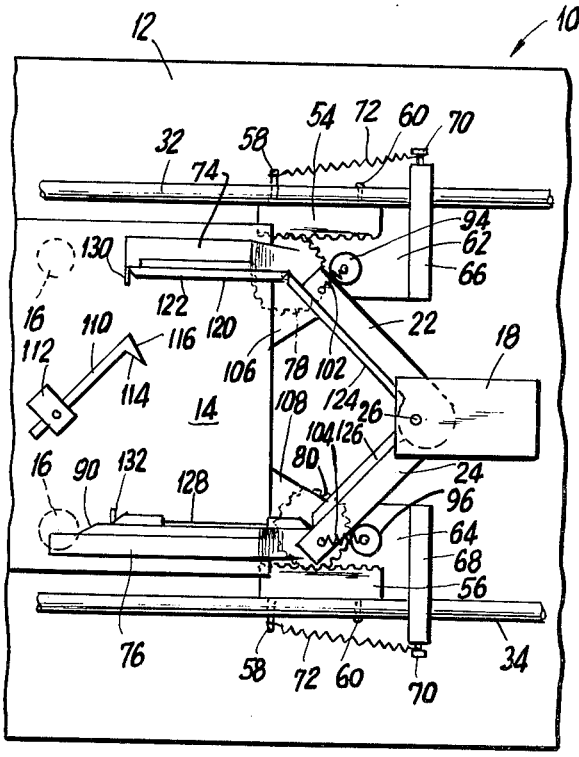

Preferably, the notches 142 between sides 122 and 124 and the notches 142 between the sides 126 and 128 are disposed directly above the pivot points of the arms 74, 76 respectively as shown in FIGS. 4 and 5, so that there is no relative movement between the arms 74, 76 and the sides 122, 128 as these members are pivoted. The pivoting as shown in FIG. 5 continues until the end of the arm 76 abuts against the surface 114 of the stop member 110. As mentioned above, this abutment occurs before the arm 74 has pivoted to its final position. Accordingly, the tab 132 is positioned so that the slot 134 therein can receive the tab 130. Furthermore, as mentioned above, the spring 52 permits the bar member 46 to continue to move the rod 32 after the rod 34 has stopped.

The arm 74 continues to pivot and is aligned by the inclined surface 116 of the stop member 110. The arm 74 is further aligned by the inclined surface 90 of the arm 76 so that the tab 130 is guided into the slot 134 to form the frame as shown in FIG. 6. Once the frame has been formed, the forward motion of the bar member 46 is stopped and then moved in reverse to position the arms as shown in FIG. 1.

With respect to the catch member 136, this member 136 is inserted into the channeled side 128 when the apparatus is in the position shown in FIG. 5. Accordingly, the magnet 92 in the arm 76 holds the catch member 136 against the side 128 for movement therewith. Additionally, the bottom member 140 can be inserted at any time after the catch member 136 has been inserted. However, if desired, the arm 76 can be positioned in the arrangement shown in FIG. 1 so that the side 128 of the strip 120 rests against the arm 76 to be held by same with the catch member 136 positioned therein.

Figure 8:
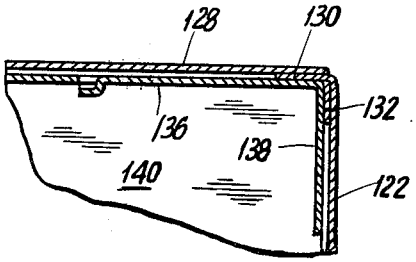
FIG. 8 represents a fragmented sectional view taken along the line 8—8 of FIG. 7.

FIG. 8 shows how the catch member 136 is positioned relative to the tabs 130 and 132, where the catch member 136 with its flanges 138 tends to conceal the tabs 130 and 132. Once completed, the box 118 is easily removed from the magnets which held same during the forming thereof.

It is further noted, that the leg portions 66, 68 position the rack members 54, 56 relative to the pinion members 78, 80 during the reverse motion of the rods 32, 34, where the rack members 54, 56 abut against the leg portions 66, 68 to move the block members 62, 64 back to the position shown in FIG. 1.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Apparatus for assembling a frame including first, second, third and fourth sides having their ends secured together to define a strip member before assembly thereof with the first and fourth sides being at opposite ends of the strip, said apparatus comprising a base member, a first pair of arms, first mounting means disposed on said base member for pivotally securing said arms to permit said arms to pivot towards each other, said arms including holding means for holding the second and third sides of the frame so that the second and third sides pivot with said arms, a second pair of arms, and second mounting means disposed on said base member for pivotally securing said second pair of arms to permit said second pair of arms to pivot towards each other after said first pair of arms have been pivoted, whereby said second pair of arms move the first and fourth sides of the frame together to provide an enclosed frame structure.

2. Apparatus as claimed in claim 1, wherein the frame is fabricated from magnetrically attractable material, said holding means being magnet means for attracting and holding the frame.

3. Apparatus as claimed in claim 1, wherein said first mounting means are secured to said base member with pivot point of said first pair of arms being disposed between said first pair of arms.

4. Apparatus as claimed in claim 3, wherein pivot points of said second pair of arms are disposed on opposite sides of said pivot point of said first pair of arms.

5. Apparatus as claimed in claim 3, including actuating means for moving said second mounting means and second pair of arms mounted thereon relative to said first mounting means secured on said base member.

6. Apparatus as claimed in claim 5, wherein said second mounting means includes engagement means for engaging and pivoting said first pair of arms towards each other.

7. Apparatus as claimed in claim 6, wherein said engagement means includes spring means connected to said first pair of arms for returning said first pair of arms to their original position before said pivoting thereof.

8. Apparatus as claimed in claim 5, wherein said actuating means includes turning means for rotating said second pair of arms about their pivot points after said second mounting means have stopped moving relative to said first mounting means.

9. Apparatus as claimed in claim 8, wherein said actuating means includes spring means for moving said second mounting means to permit said turning means to move relative to said second mounting means after said second mounting means have stopped moving relative to said first mounting means.

10. Apparatus as claimed in claim 8, wherein said turning means rotates one of said arms of said second pair before the other of said arms of said second pair, whereby the fourth side of the frame is in its final position before the first side of the frame.

11. Apparatus as claimed in claim 10, wherein said actuating means includes spring means to permit one member of said turning means associated with said one arm of said second pair to stop while another member of said turning means continues to rotate said other arm of said second pair.

12. Apparatus as claimed in claim 10, including stop means disposed on said base member for stopping said one arm of said second pair when the fourth side of the frame is in its final pivoted position.

13. Apparatus as claimed in claim 12, wherein said stop means includes an inclined surface for aligning said other arm of said second pair with said one arm of said second pair to provide a corner of the frame between the first and fourth sides thereof.

14. Apparatus as claimed in claim 13, wherein said one arm of said second pair is provided with an inclined surface for further alignment of said other arm of said second pair to provide the frame corner.

15. Apparatus as claimed in claim 4, wherein each of said pivot points is in alignment with an associated corner defined by said arms of said first and second pairs in their pivoted positions, whereby each of said arms moves an associated side of the frame without any movement therebetween.

16. Apparatus as claimed in claim 1, wherein one of said arms of said second pair includes magnetic means to position a magnetically attractable member relative to the fourth side of the frame for movement therewith.

17. Apparatus as claimed in claim 1, including stop means disposed on said base member for stopping said first pair of arms when the second and third sides of the frame are in their final pivoted position.

18. Apparatus as claimed in claim 17, including a platform member disposed above said base member, said second pair of arms being movable above said platform to close the frame structure.

19. Apparatus as claimed in claim 18, wherein said stop means are disposed below said platform.

* * * * *